US008872659B2

(12) United States Patent
Berglund et al.

(10) Patent No.: US 8,872,659 B2
(45) Date of Patent: Oct. 28, 2014

(54) MERCHANDISE DISPLAY SECURITY DEVICE FOR HEADPHONES

(75) Inventors: David N. Berglund, Charlotte, NC (US); Jonathon D. Phillips, Fort Mill, SC (US); Robert Schultz, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 179 days.

(21) Appl. No.: 13/351,287

(22) Filed: Jan. 17, 2012

(65) Prior Publication Data

US 2012/0182146 A1 Jul. 19, 2012

Related U.S. Application Data

(60) Provisional application No. 61/433,332, filed on Jan. 17, 2011.

(51) Int. Cl.
*G08B 13/12* (2006.01)
*G08B 13/14* (2006.01)

(52) U.S. Cl.
CPC ..... *G08B 13/1445* (2013.01)
USPC ..... 340/568.2; 340/573.1; 340/825.24

(58) Field of Classification Search
USPC ..... 340/568.2, 586.1, 568.1, 568.3, 568.4, 340/561, 566, 568.8, 571, 572.1–572.9, 340/573.1, 825.24, 3.62
See application file for complete search history.

(56) References Cited

U.S. PATENT DOCUMENTS 5,825,291 A * 10/1998 Platt et al. ..... 340/572.7
6,150,940 A * 11/2000 Chapman et al. ..... 340/568.3
6,150,942 A * 11/2000 O'Brien ..... 340/573.1
2001/0007474 A1* 7/2001 Gertz ..... 348/373
2005/0073413 A1 4/2005 Sedon et al.
2006/0092773 A1* 5/2006 Hsu et al. ..... 369/30.01
2007/0001845 A1 1/2007 Ott
2007/0099681 A1* 5/2007 Kielland ..... 455/575.1
2007/0146134 A1* 6/2007 Belden et al. ..... 340/571
2008/0169923 A1 7/2008 Belden et al.
2010/0238031 A1* 9/2010 Belden et al. ..... 340/568.1

FOREIGN PATENT DOCUMENTS

JP 2004070921 A1 3/2004

OTHER PUBLICATIONS

Notification of Transmittal of International Search Report and Written Opinion of the International Searching Authority, or the Declaration in counterpart International Patent Application No. PCT/US2012/021502; mailed Aug. 23, 2013; 10 pages.

* cited by examiner

*Primary Examiner* — Daniel Previl
(74) *Attorney, Agent, or Firm* — InVue Security Products Inc.

(57) ABSTRACT

A merchandise display security device for an article of merchandise having an audio cord includes an electrical control circuit for producing a sense loop in the audio cord, monitoring a non-alarming state and an alarming state of the sense loop, and activating an alarm in the event that the sense loop changes from the non-alarming state to the alarming state. In one embodiment, the device includes a security sensor adapted for being attached to a media player. The security sensor has an audio jack for receiving an audio plug on the audio cord and includes an audio connector cord having an audio plug for engaging an audio jack on the media player. The security sensor may be electrically connected to an alarming base by a sense cord and include a power adapter cord for providing power to the media player through the sense cord and the power adapter cord.

20 Claims, 12 Drawing Sheets

MERCHANDISE DISPLAY SECURITY DEVICE FOR HEADPHONES

CROSS REFERENCE TO RELATED APPLICATION

This utility application claims the benefit of U.S. Provisional Application No. 61/433,332 filed on Jan. 17, 2011, the disclosure of which is incorporated herein by reference.

FIELD OF THE INVENTION

This invention relates generally to merchandise display systems for displaying and protecting articles of merchandise from theft. More particularly, the invention is a merchandise display security device for displaying headphones in a retail store for purposes of evaluation by a potential purchaser, while protecting the headphones from theft or removal from a display area by an unauthorized person.

BACKGROUND OF THE INVENTION

Retailers routinely display relatively expensive electronic articles of merchandise, including media players and headphones, for a potential purchaser to examine before making a purchase. Retailers often desire the electronic articles of merchandise to be displayed in an operational mode so that the potential purchaser can evaluate (e.g. test) the features and function of the merchandise as well. For example, the retailer might desire to permit a potential purchaser to experience the sound quality of audio equipment and components, such as MP3 players and headphones. At the same time, the retailer does not want the articles of merchandise being displayed to be stolen or removed from the display area by an unauthorized person. Accordingly, the articles of merchandise are oftentimes physically attached and/or electrically connected to a merchandise display security device that monitors and protects the article from the theft or removal. Such merchandise display security devices typically include a security sensor attached to the article of merchandise that houses a sensor for monitoring whether the article remains securely attached to the security sensor. In the event that the article of merchandise is detached from the security sensor, an audible and/or visible alarm is activated to alert store personnel of a possible theft or removal.

Most audio players are of a sufficient size and have a suitable surface for attaching a security sensor to the display article of merchandise without the security sensor interfering with the manipulation and operation of the audio player by the potential purchaser. In addition, a relatively short power cord can be provided between the audio player and the security sensor that does not become entangled with an electrical sense cord of the merchandise display security device. Headphones, on the other hand, oftentimes have little or no surface geometry suitable for attaching a security sensor, such as a relatively flat surface large enough to securely attach the mounting surface of the security sensor and rigid enough to prevent the introduction of an unauthorized removal tool. Headphones also typically have a relatively long audio cord that electrically connects the headphones to an audio player. The audio cord can easily become entangled with the sense cord that extends between the security sensor and a base, or display stand, of the merchandise display security device. Furthermore, the presence of a sense cord from the merchandise display security device in addition to the audio cord results in a significantly greater number of electrical cables that detracts from the visual aesthetics of the display area.

However, if only the audio player is attached to a security sensor electrically connected to the merchandise display security device, the audio cord of the headphones can simply be unplugged from the audio player and the headphones stolen or removed from the display area without activating an alarm of the security device.

Accordingly, there exists need for an improved merchandise display security system for displaying and protecting an audio player and headphones from theft. There exists a further, and more specific, need for a merchandise display security device for displaying headphones in a retail store for purposes of evaluation by a potential purchaser, while protecting the headphones from theft. There exists a particular need for a merchandise display security device for displaying and protecting headphones that does not require a security sensor having a sense cord that extends between the security sensor and a base (e.g. display stand) of the security device. Specifically, a merchandise display security device is needed for protecting headphones displayed with an audio player for the purpose of evaluating the headphones and/or the audio player that includes an electrical sense cord that will not become entangled with the audio cord of the headphones and does not detract from the aesthetics of the display area, while preventing theft or removal from the display area by an unauthorized person.

DETAILED DESCRIPTION OF EXEMPLARY EMBODIMENTS

Figure 1:
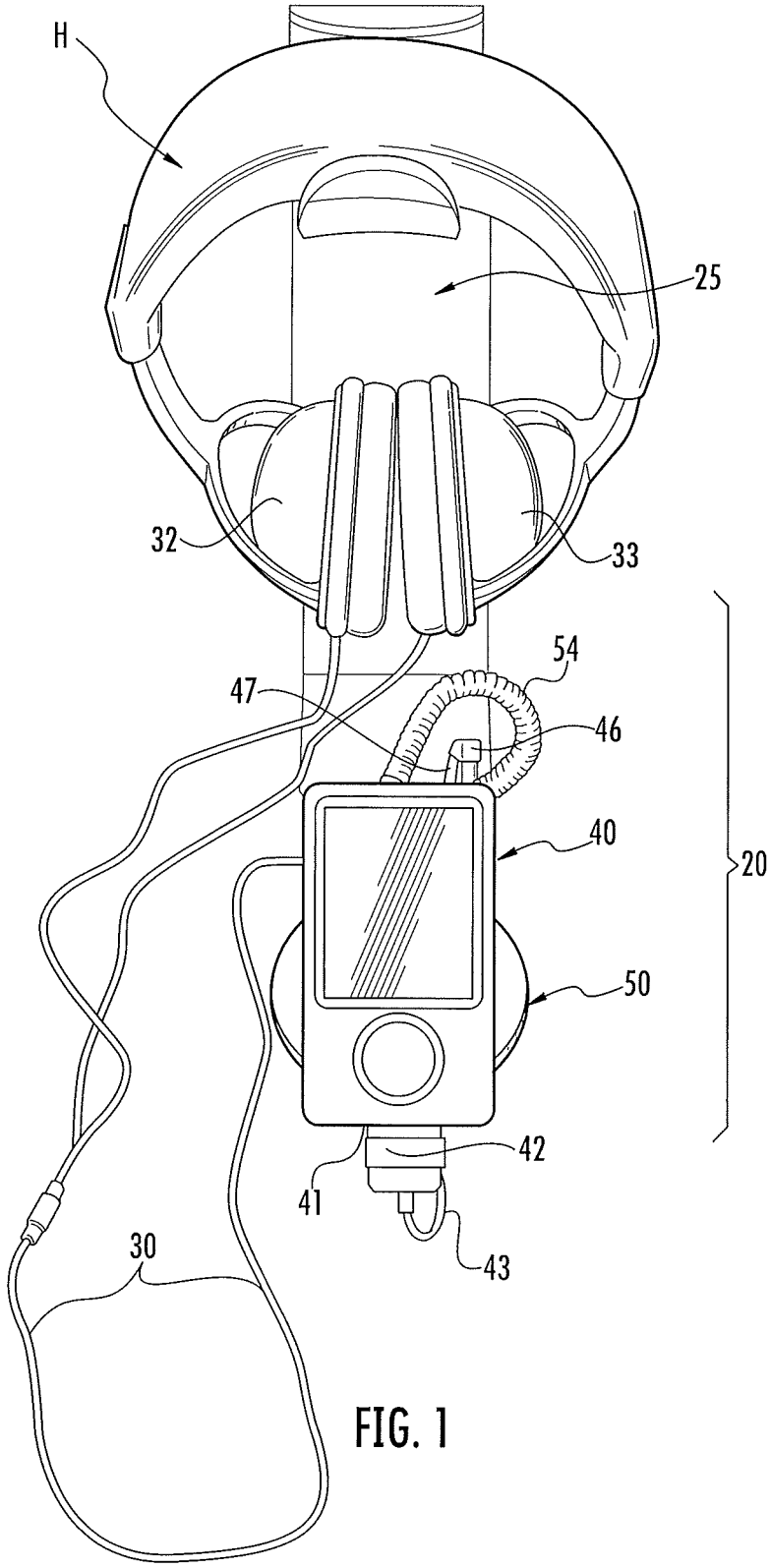
FIGS. 1-4 illustrate a first exemplary embodiment of a merchandise display security device for displaying and protecting headphones according to the present invention.

Referring now to the accompanying drawing figures wherein like reference numerals denote like elements throughout the various views, exemplary embodiments of a merchandise security system for displaying and protecting an article of merchandise are shown. More particularly, each exemplary embodiment is a merchandise display security device for displaying and protecting headphones, indicated generally by reference character H, from theft or removal. In each exemplary embodiment, the merchandise display security device activates an audible and/or visible alarm in the event that the headphones are separated from the security device. More particularly, an audible and/or visible alarm is activated if a sense loop within the audio cord of the headphones is interrupted. Specifically, the alarm is activated when the audio cord of the headphones is unplugged from the merchandise display security device or when the audio cord is severed. In one embodiment, an objective of the present invention is to display and protect the headphones H in addition to preventing the unauthorized removal or theft of a media player, indicated generally by reference character 40, for example an audio player. In another embodiment, an objective of the present invention is to display and protect the headphones H, while at the same time permitting a potential purchaser to evaluate the operation of the headphones H with various media players 40, including the customer's own audio player.

FIGS. 1-4 illustrate a first exemplary embodiment of a merchandise display security device 20 for displaying and protecting headphones H from theft or removal by an unauthorized person from a display area of a retail store. The headphones H may be any conventional type, model or style having an audio cord 30 for electrically connecting the headphones to a media player 40 configured to produce an audio signal. As shown and described herein, the media player 40 is an audio player and the audio cord 30 is a conventional electrical cable comprising at least a pair of conductors for conducting an electrical audio signal from the audio player to the headphones H. In a conventional manner, the headphones H comprise a pair of earpieces 32, 33 (e.g. left and right), and a first conductor of the pair of conductors of the audio cord 30 is routed to a speaker disposed within one earpiece 32, while a second conductor of the pair of conductors of the audio cord 30 is routed to the other earpiece 33. Alternatively, the first conductor and the second conductor of the audio cord 30 may both be routed to a first earpiece 32 and the second earpiece 33 may be electrically connected to the first earpiece through the headphones H via one or more additional conductors. Furthermore, the audio cord 30 may comprise a connector, such as an audio plug (not shown), for engaging a corresponding connector, such as an audio jack (not shown), provided on the headphones H. As shown herein, the audio cord 30 is hard-wired to the headphones H, and more particularly, to the earpieces 32, 33. The free end of the audio cord 30 comprises a connector, and in particular an audio plug 34, configured to engage a corresponding audio connector, and in particular an audio jack. In normal operation, the audio plug 34 engages an audio jack 45 provided on the audio player 40. However, as explained hereinafter, in accordance with the present invention the audio plug 34 engages an audio jack 66 provided on a security sensor 60. Furthermore, headphones H may be supported on an optional display stand 25 in a desired orientation for display in a retail store.

Figure 2:
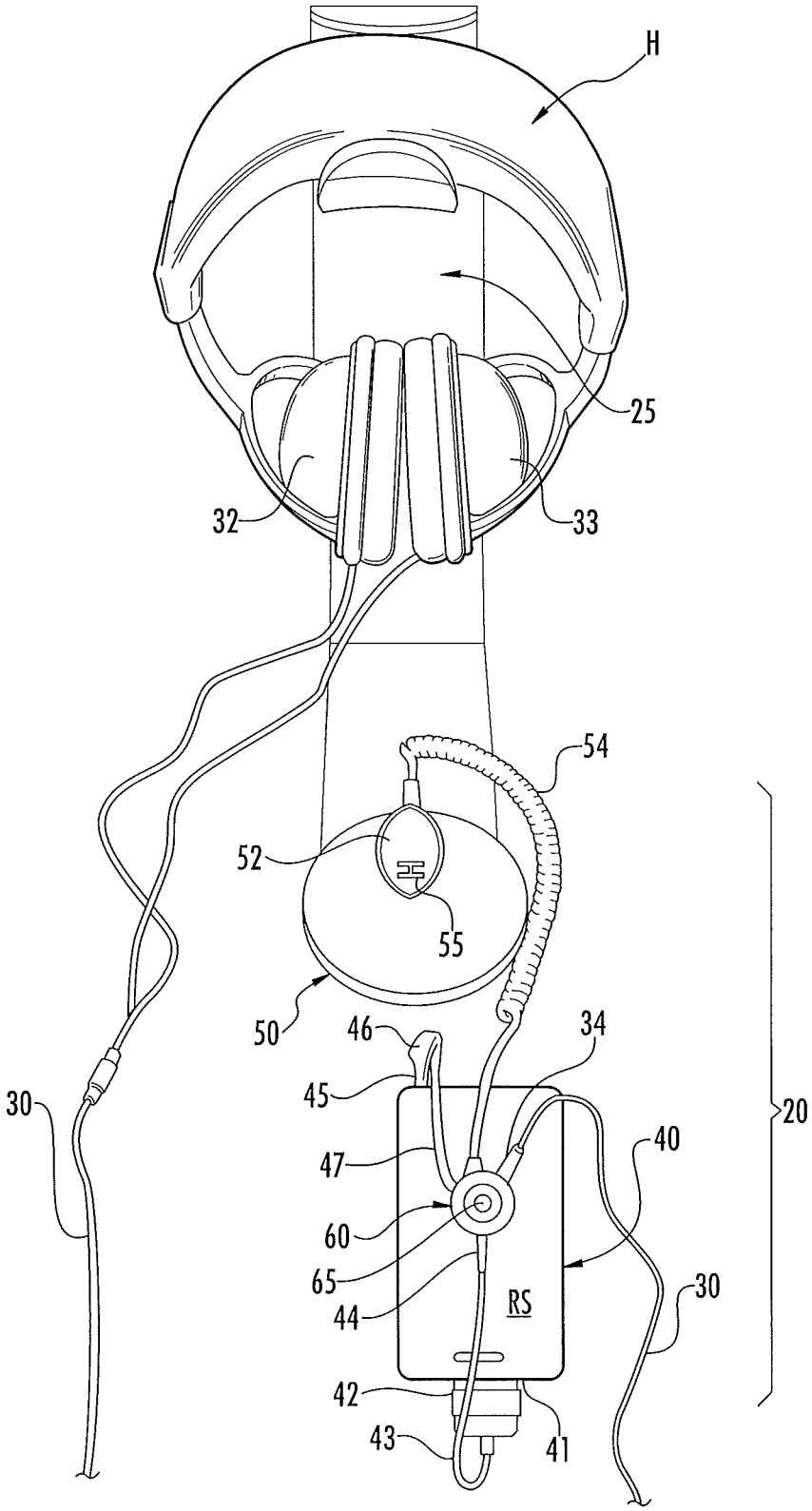
Figure 3:
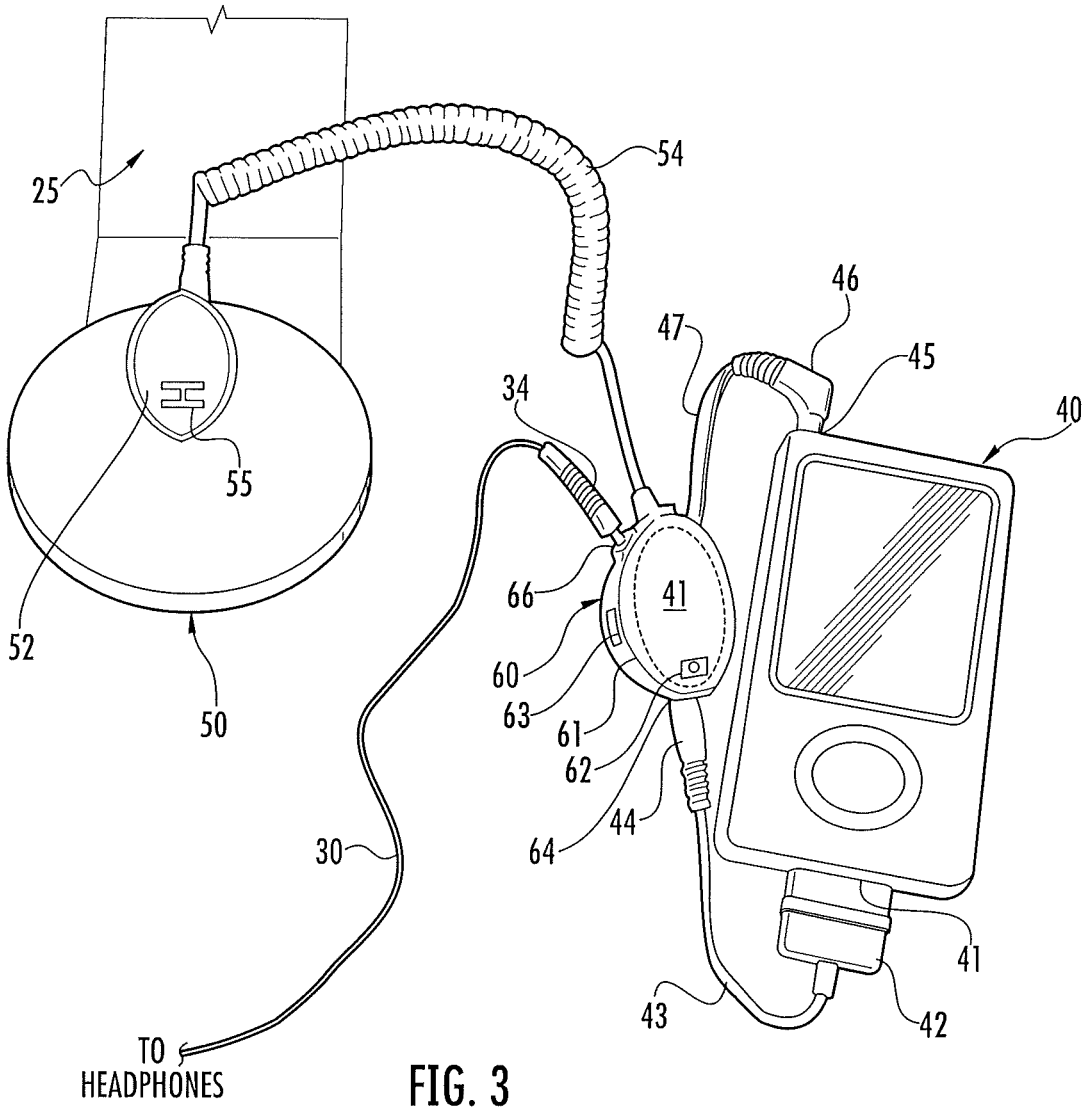

As best shown in FIGS. 1-3, the merchandise display security device 20 comprises an alarming base 50 for supporting a security sensor 60 (visible in FIG. 2 and FIG. 3). Sensor 60 is attached to the underside, or rear surface, RS of the audio player 40 in a conventional manner, for example by a relatively thin layer of a pressure sensitive adhesive (PSA) 41, such as double-sided tape (FIG. 3). The alarming base 50 comprises an internal electrical control circuit, also referred to herein as power electronics and/or sensor electronics. The sensor electronics in the alarming base 50 monitor the state of one or more sensors in a known manner. For example, the sensor electronics may monitor a sensor disposed within the security sensor 60 for indicating whether the audio player 40 has become detached from the security sensor. The alarming base 50 may comprise an optional pedestal 52 configured (i.e. sized and shaped) for receiving and removably supporting the security sensor 60 on the alarming base. If desired, pedestal 52 and security sensor 60 may be provided with a securing and aligning mechanism, for example magnets 55, 65, respectively, to securely hold the security sensor on the alarming base 50 in an aligned orientation for display. The security sensor 60 is mechanically and electrically connected to the alarming base 50 by an electrical sense cord 54 comprising at least a pair of conductors. As shown herein, the sense cord 54 is a helical coil cable of the type commonly referred to as a "telephone cord." Preferably, sense cord 54 is hard-wired at each end to the alarming base 50 and to the security sensor 60, respectively. However, if desired, sense cord 54 may comprise a releasable connector at either end so that the sense cord and/or the security sensor 60 may be replaced in the event of damage or failure.

In one embodiment, the security sensor 60 has a relatively flat engagement surface 61 having an opening through which a proximity switch, limit switch or the like, indicated generically herein as contact sensor 62 (FIG. 3), extends. The relatively flat rear surface RS (FIG. 2) of the audio player 40 is securely attached to the engagement surface 61 of the security sensor 60 by the PSA 41 previously mentioned. If desired, the security sensor 60 may also be provided with an elongate opening or channel 63 (FIG. 3) that extends laterally through the security sensor for receiving a cable tie or the like (not shown) to secure the audio player 40 onto the security sensor. Regardless, the contact sensor 62 engages the rear surface RS of the audio player 40 and is electrically connected to the sensor electronics disposed in the alarming base 50 of the merchandise display security device 20 either directly, or alternatively, through an electrical control circuit disposed within the security sensor 60. The status of contact sensor 62 changes between an un-activated, or non-alarming, state when the audio player 40 is securely attached to the security sensor 60, and an activated, or alarming, state when the audio player 40 is separated from the security sensor 60. Control electronics may also be provided within the alarming base 50 or the security sensor 60 for altering the status of the contact sensor 62 between an on or "armed" state, and an off or "unarmed" state, in a known manner. Regardless, an audible and/or visible alarm in electrical communication with the electrical control circuit disposed within the alarming base 50 and/or the security sensor 60 is activated when the contact sensor 62 is in an armed state and the audio player 40 is separated (e.g. removed) from the contact sensor.

Importantly, the audio player 40 comprises a conventional power input jack 41 and a conventional audio output jack 45. As such, the merchandise display security device 20 comprises a power adapter cord 43 having a suitable connector 42 at one end for engaging the power input jack 41 of the audio player 40 and a connector plug 44 for engaging a power output jack 64 provided on the security sensor 60. Preferably, the connector plug 44 releasably engages the power output jack 64 on the security sensor 60 so that different power adapter cords 43 may be used to electrically connect different medial players 40 to the security sensor 60. The electronics disposed within the security sensor 60 provide electrical power at the appropriate voltage and current levels from the alarming base 50 to the audio player 40 through sense cord 54 and power adapter cord 43. Merchandise display security device 20 similarly comprises an audio connector cord 47 having a suitable connector 46, such as a conventional audio plug, at one end for engaging the audio output jack 45 of the audio player 40. The other end of the audio connector cord 47 is preferably hard-wired to the security sensor 60 since the audio output jack 45 of most audio players 40 has a standard configuration for receiving a conventional style audio plug (sometimes referred to as a barrel connector) and, therefore, different audio connector cords are not required for different audio players. If desired, the alarming base 50 or the security sensor 60 may include an AC/DC transformer and a regulator for converting the power input voltage to the appropriate power operating voltage for the audio player 40. Accordingly, the alarming base 50 of the merchandise display security device 20 may comprise an internal power source, or alternatively, may be electrically connected to an external power source (not shown).

In either case, the sense cord 54 and the power adaptor cord 43 are electrically connected to the power source provided by the merchandise display security device 20 to provide power to the audio player 40 through the power input connector 42 at the end of the power adapter cord that is configured to be electrically connected to the power input jack 41 of the audio player. An alarming base 50 and a security sensor 60 suitable for use with the present invention are available from InVue Security Products Inc. of Charlotte, N.C., USA. As previously mentioned, the security sensor 60 is mechanically and electrically connected to the alarming base 50 of the merchandise display security device 20 through a helical coil cable (i.e. sense cord) 54 containing a plurality of conductors. At least some of the conductors of the sense cord 54 are electrically connected at one end to the power and/or sensor electronics disposed within the alarming base 50 and are electrically connected at the other end to the control electronics disposed within the security sensor 60. At least some of the other conductors of the sense cord 54 are electrically connected at one end to the internal power source within the alarming base 50, or alternatively, to the external power source, and electrically connected at the other end to the power output jack 64 provided on the security sensor 60.

The electrical control circuit disposed within the security sensor 60 further transfers an audio signal from the audio player 40 to the headphones H through the audio connector cord 47 and the audio cord 30. Specifically, the conductors of the audio connector cord 47 are electrically connected to the control electronics of the security sensor 60, which in turn is electrically connected to an audio output jack 66 of the security sensor. The audio plug 34 electrically connects the conductors of the audio cord 30 to the electronics of the security sensor 60 through the audio output jack 66. In addition, the electrical control circuit produces a sense loop between the headphones H and the security sensor 60 through the conductors of the audio cord 30. The control electronics disposed within the security sensor 60 monitor the status of the sense loop. Alternatively, the sense loop is electrically connected to and monitored by the sensor electronics disposed within the alarming base 50. In either instance, the merchandise display security device 20 comprises an audible and/or visible alarm in electrical communication with the electrical control circuit disposed within the alarming base 50 and/or the security sensor 60 that is activated in the event the sense loop is interrupted. As used herein, the term "interrupted" means that electrical continuity is lost between the conductors of the audio cord 30 and the electronics monitoring the status of the sense loop.

Figure 4:
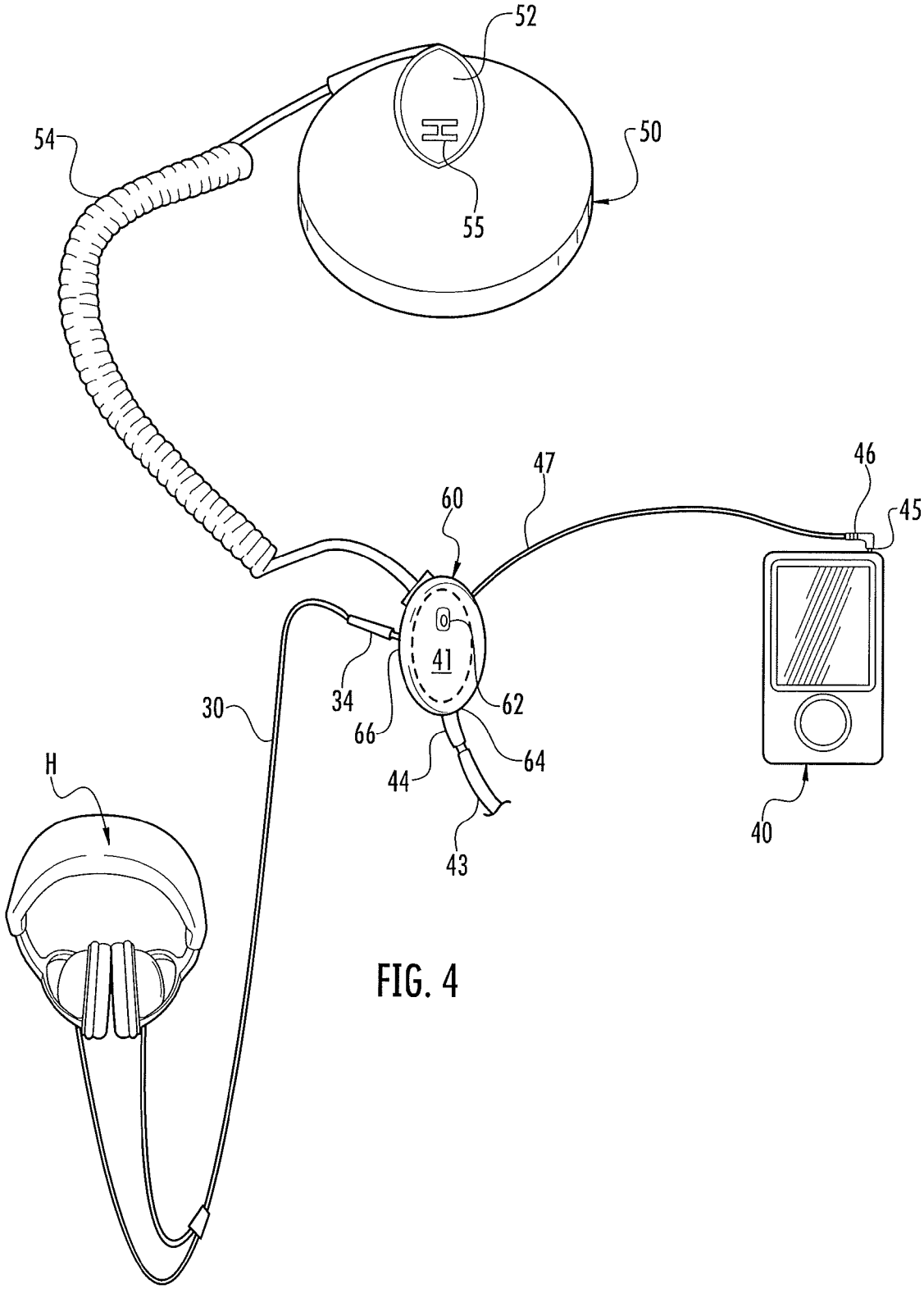

As best illustrated by FIG. 4, the alarm of the merchandise display security device 20 is activated under one of several situations, conditions or circumstances. In one instance, the sensor electronics disposed within the alarming base 50 monitor the status of the sense cord 54 and activate the alarm if the sense cord is severed (e.g. electrical continuity along the conductors of the sense cord is interrupted). In the event that the sense cord 54 is provided with a releasable connector at either end, the alarm is also activated if the sense cord is unplugged at the alarming base 50 or at the security sensor 60. In another instance, the sensor electronics disposed within the alarming base 50 or the control electronics disposed within the security sensor 60 monitor the status of the audio cord 30 and activate the alarm if the audio cord is severed (e.g. electrical continuity along the conductors of the audio cord is interrupted). The alarm is also activated if the audio cord 30 is unplugged at the security sensor 60. In the exemplary embodiment of FIGS. 1-4, the sensor electronics disposed within the alarming base 50 also monitor the status of the contact sensor 62 and activate the alarm in the event that the audio player 40 and the security sensor 60 become separated. For example, the alarm is activated in the event that the adhesive bond of the PSA 41 between the audio player 40 and the security sensor 60 is broken or is sufficiently weakened.

FIGS. 5-9 illustrate a second exemplary embodiment of a merchandise display security device 120 for displaying and protecting headphones H from theft or removal from a display area, for example in a retail store, by an unauthorized person. Unlike the security device 20 previously described, the security device 120 displays and protects the headphones H from theft or removal, but does not display or protect an associated media player 40. In this manner, the headphones H may be evaluated with different types, styles and models of media players 40, and more particularly, with various audio players, including an audio player provided by a potential purchaser of the headphones.

Figure 5:
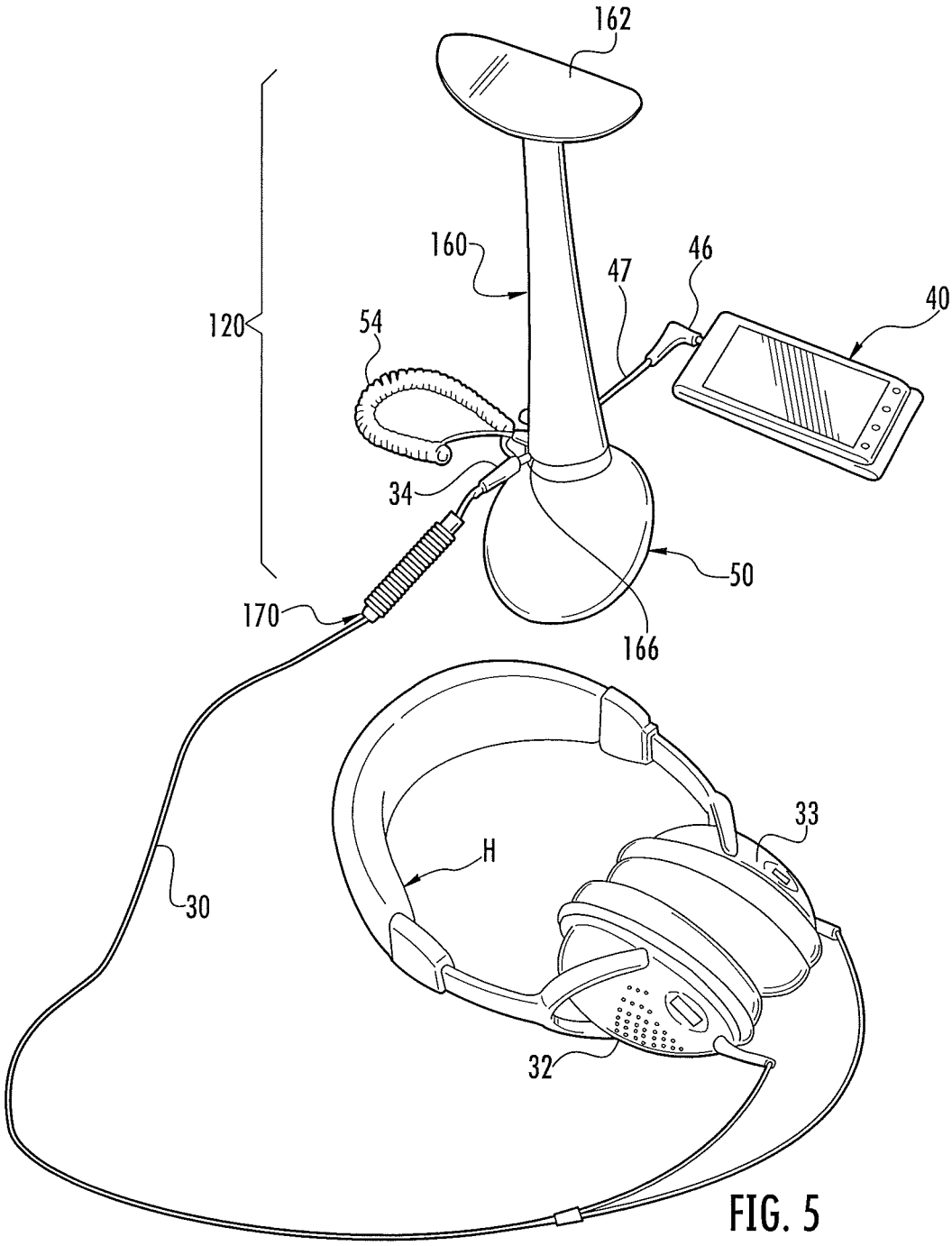
FIGS. 5-9 illustrate a second exemplary embodiment of a merchandise display security device for displaying and protecting headphones according to the present invention.
Figure 6:
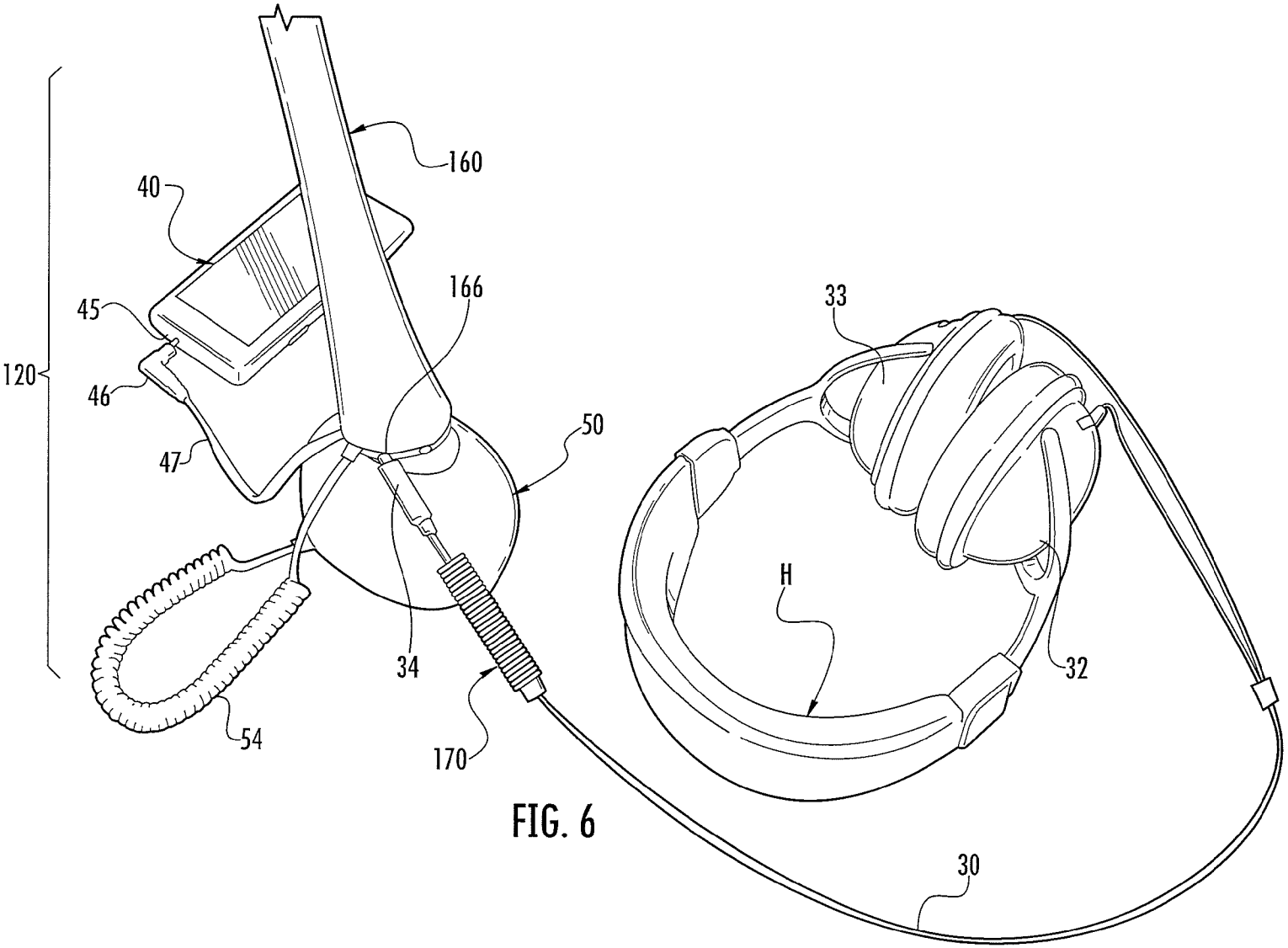
Figure 7:
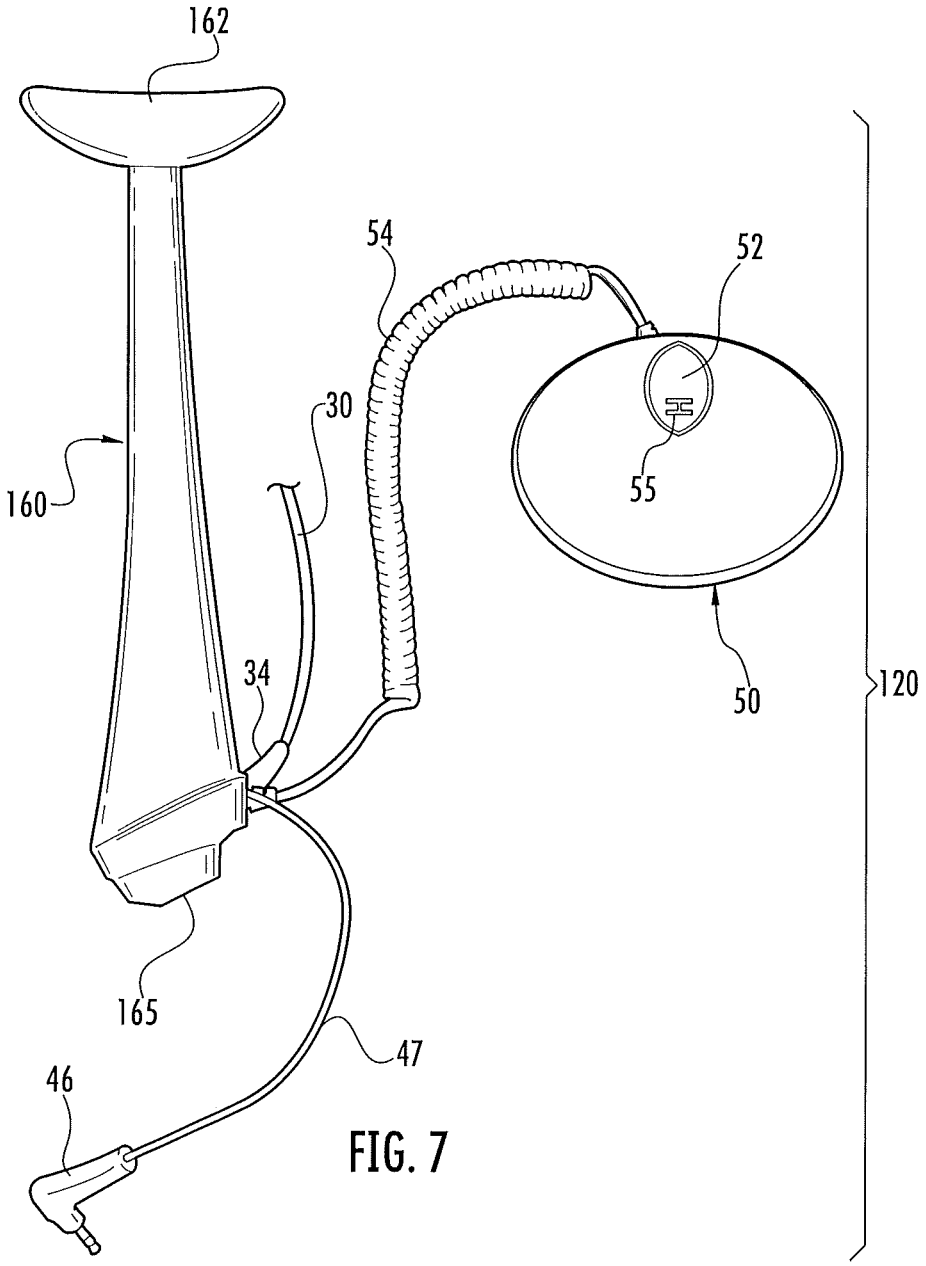

As best shown in FIGS. 5-8, the merchandise display security device 120 comprises an alarming base 50 essentially as previously described and a display stand 160 extending upwardly from the alarming base. Importantly, the security device 120 does not comprise a security sensor 60 attached to the media player 40. The alarming base 50 and display stand 160 essentially substitute for the security sensor 60 since the media player 40 is not displayed or protected by the retailer. The display stand 160 instead is electrically connected to the sense cord 54 and the audio cord 30, respectively. Accordingly, the control electronics disposed within the security sensor 60 of the security device 20 are disposed within the display stand 160 of the security device 120. As such, the sense cord 54 electrically connects the sensor electronics of the alarming base 50 and the control electronics of the display stand 160, while the audio cord 30 electrically connects the headphones H to the control electronics of the display stand and subsequently to the sensor electronics of the alarming base through the sense cord 54. The audio connector cord 47 electrically connects the media player 40 to the control electronics of the display stand 160. The sense cord 54 may be hard-wired between the alarming base 50 and the display stand 160, or alternatively, a releasable connector may be provided at either end of the sense cord. As previously described, the audio cord 30 comprises an audio plug 34 at the free end that engages an audio jack 166 (FIG. 6) provided on the display stand 160. Similar to the security device 20, a first end of the audio connector cord 47 comprises a connector (e.g. audio plug) 46 that engages an audio jack 45 (FIG. 6) provided on the media player 40, while the other end of the audio connector cord is preferably hard-wired to the display stand 160. Headphones H are preferably displayed on a cradle portion 162 of the display stand 160 in a desired orientation. As illustrated in FIG. 7, display stand 160 may be removably held on alarming base 50 in a desired orientation using magnets 55, 165 provided on the alarming base and the display stand, respectively, as previously described.

Figure 8:
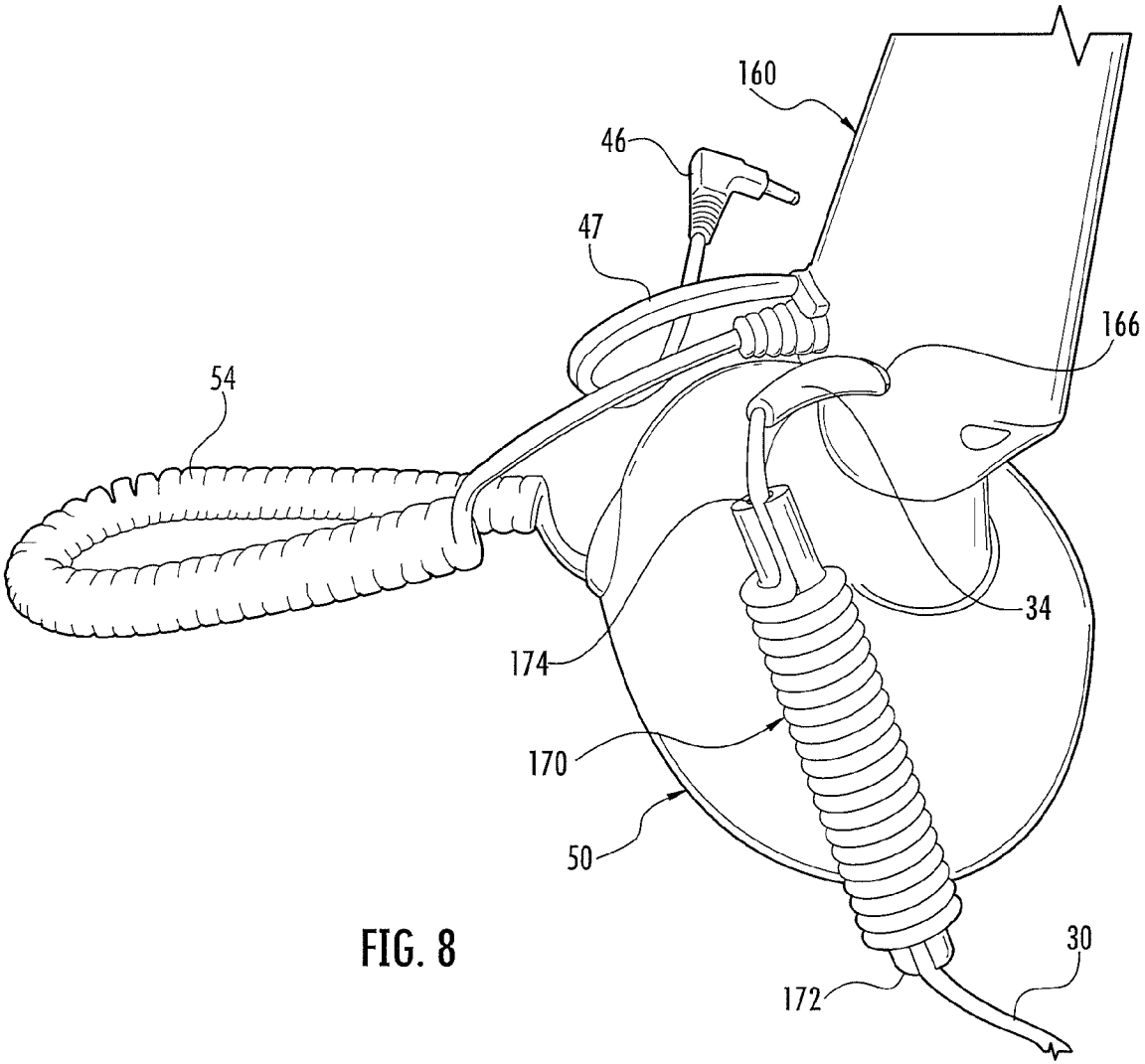

FIGS. 5, 6 and 8 also illustrate a collecting spool 170 for storing an excess length of the audio cord 30. The spool 170 comprises an elongate cylindrical rod 172 having a slot 174 formed adjacent each end of the rod. The excess length of the audio cord 30 is coiled around the rod 172 of the spool 170 and is inserted into the slots 174 at the ends of the rod to secure the coils of the audio cord on the rod. In this manner, the length of the audio cord 30 extending between the headphones H and the display stand 160 is made both manageable and more aesthetically pleasing.

Figure 9:
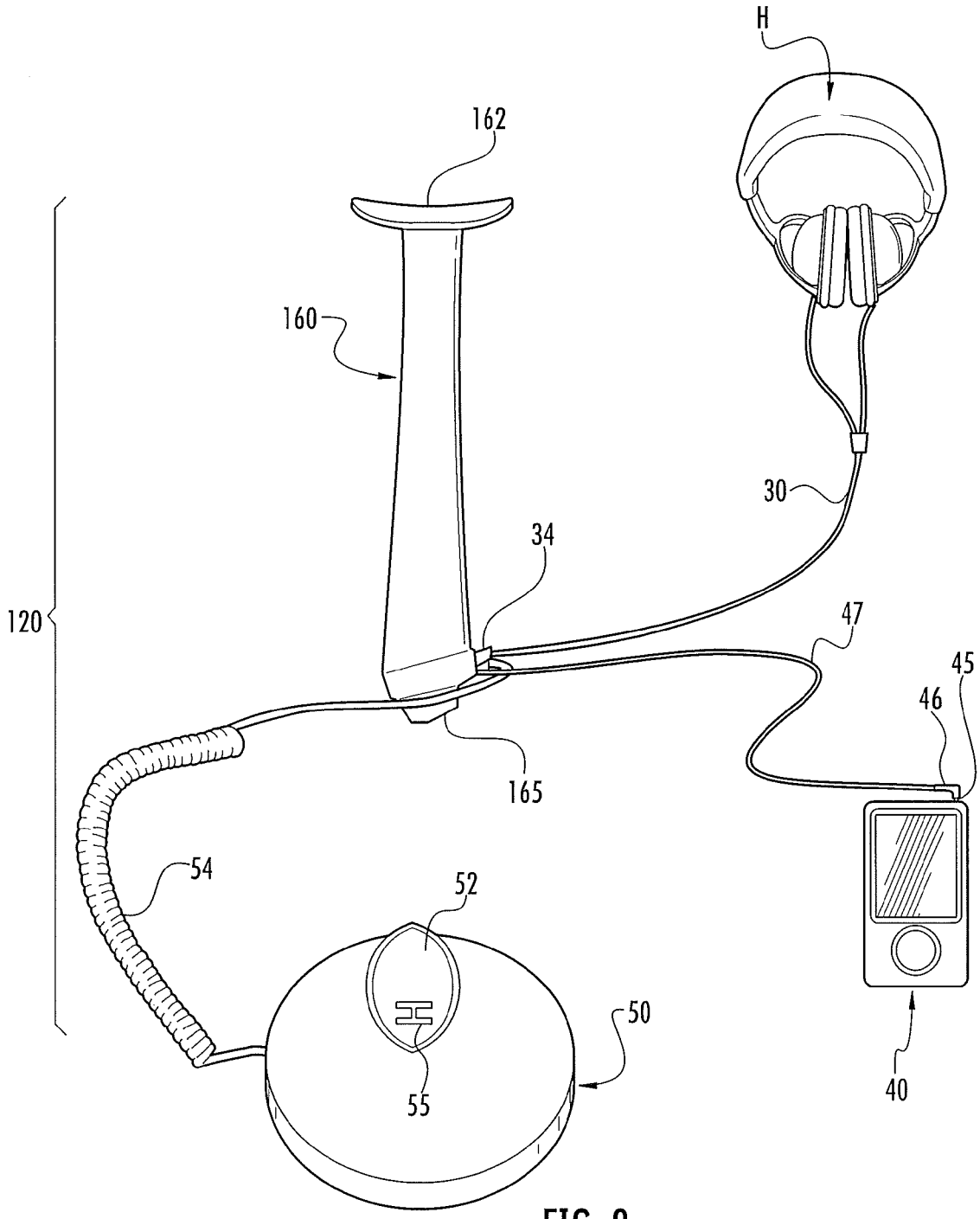

As best illustrated by FIG. 9, the alarm of the merchandise display security device 120 is activated under one of two situations, conditions or circumstances. In one instance, the electronics disposed within the alarming base 50 monitor the status of the sense cord 54 and activate the alarm if the sense cord is severed (e.g. electrical continuity along the conductors of the sense cord is interrupted). In the event that the sense cord 54 is provided with a releasable connector at either end, the alarm is also activated if the sense cord is unplugged at the alarming base 50 or at the display stand 160. In another instance, the electronics disposed within the display stand 160 monitor the status of the audio cord 30 and activate the alarm if the audio cord is severed (e.g. electrical continuity along the conductors of the audio cord is interrupted), or if the audio plug 34 of the audio cord is unplugged at the display stand.

Figure 10:
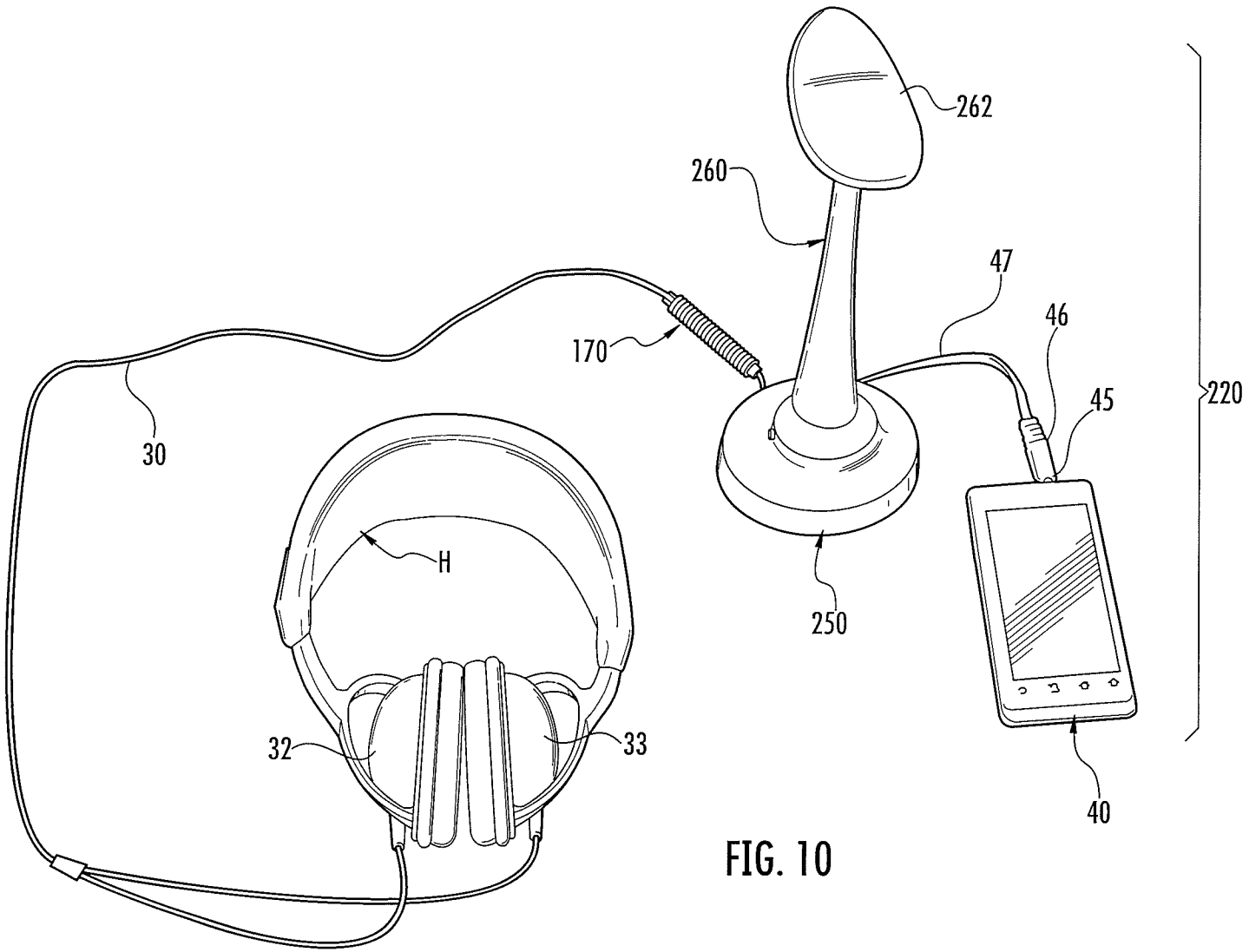
FIGS. 10-12 illustrate a third exemplary embodiment of a merchandise display security device for displaying and protecting headphones according to the present invention.
Figure 11:
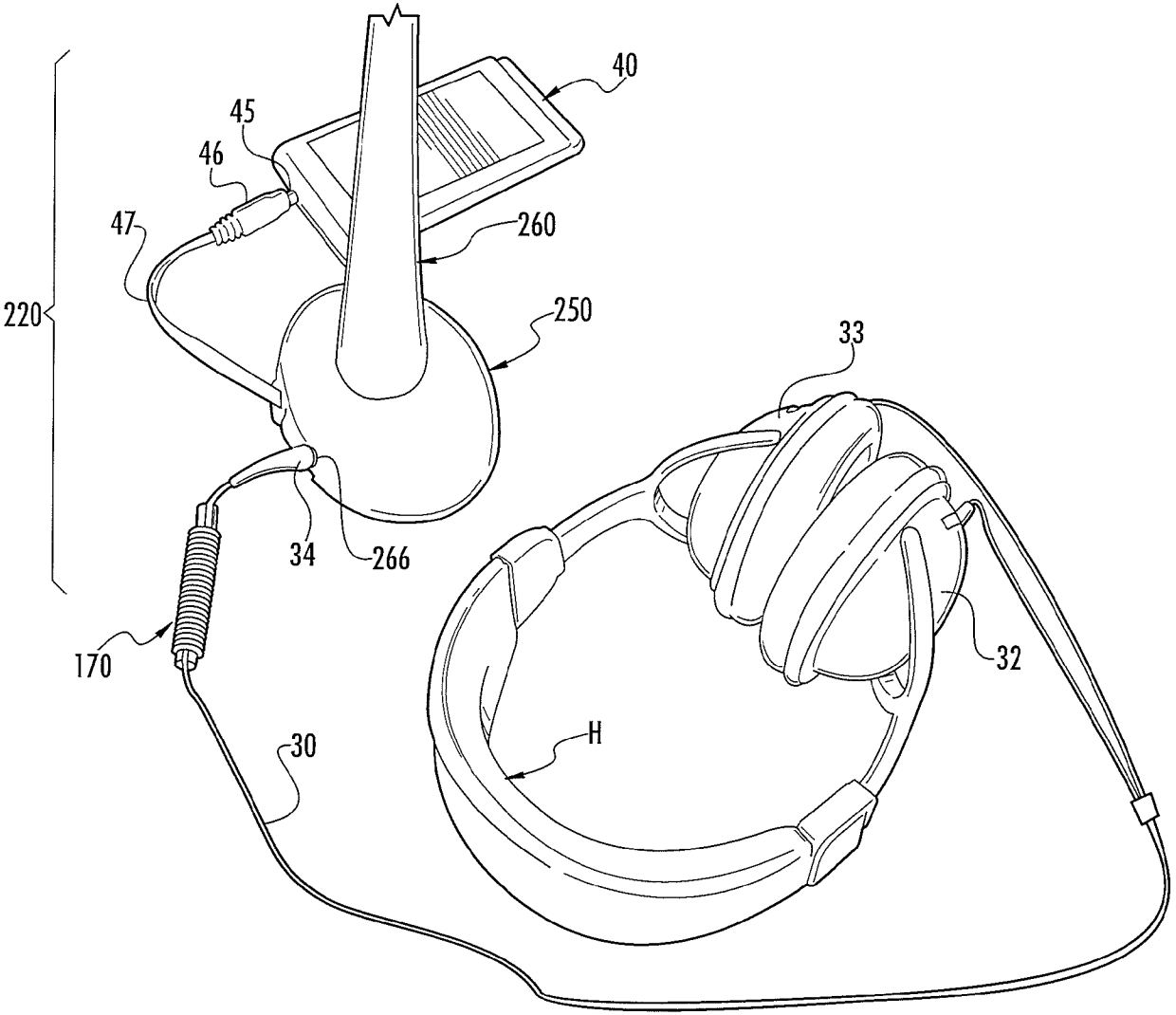
Figure 12:
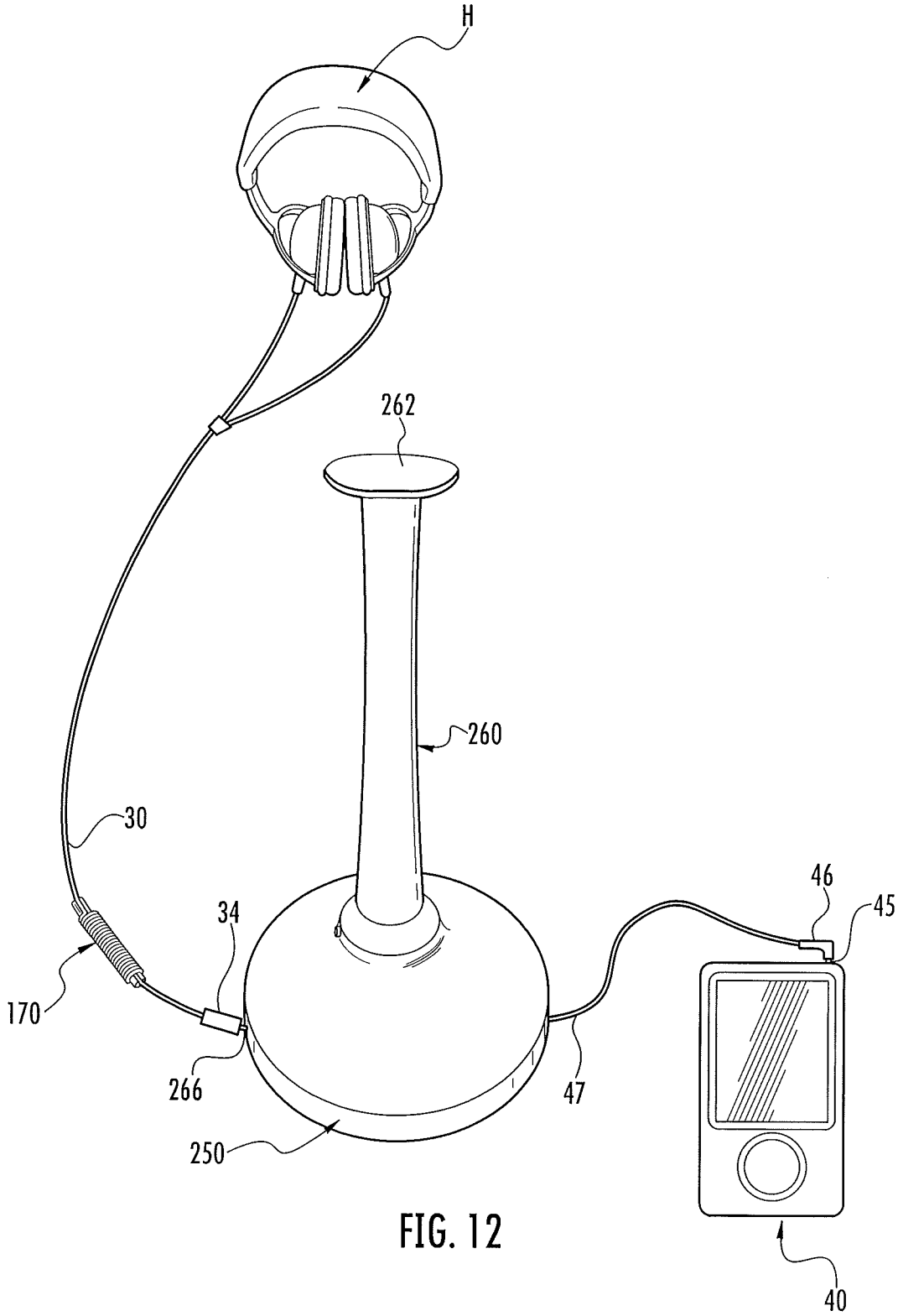

FIGS. 10-12 illustrate a third exemplary embodiment of a merchandise display security device 220 for displaying and protecting headphones H from theft or removal from a display area, for example in a retail store, by an unauthorized person. Unlike the security device 20 previously described, the security device 220 displays and protects the headphones H from theft or removal, but does not display or protect an associated media player 40. In this manner, the headphones H may be evaluated with different types, styles and models of media players 40, and more particularly, with various audio players, including an audio player provided by a potential purchaser of the headphones.

As best shown in FIGS. 10 and 11, the merchandise display security device 220 comprises an alarming base 250 similar to alarming base 50 as previously described except as mentioned herein and a display stand 260 attached to, or alternatively, removably supported on the alarming base. Importantly, the security device 220 does not comprise a security sensor 60 attached to the media player 40. Furthermore, the alarming base 250 is not mechanically or electrically connected to a security sensor 60 as shown and described herein with respect to the security device 20, or to a display stand 160 as shown and described herein with respect to security device 120. As a result, the need for the sense cord 54 previously described is eliminated and the alarming base 250 instead is mechanically and electrically connected directly to the headphones H through the audio cord 30 and to the media player 40 through the audio connector cord 47.

Accordingly, the control electronics disposed within the security sensor 60 of the security device 20 and the sensor electronics of the display stand 160 of the security device 120 are disposed within the alarming base 250 of the security device 220. As such, the audio cord 30 electrically connects the headphones H directly to the control electronics and the sensor electronics disposed within the alarming base 250, while the audio connector cord 47 electrically connects the media player 40 directly to control electronics disposed within the alarming base. As previously described, the audio cord 30 comprises an audio plug 34 at the free end that engages an audio jack 266 provided on the alarming base 250. Similar to the security device 20 and the security device 120, a first end of the audio connector cord 47 comprises a connector (e.g. audio plug) 46 that engages an audio jack 45 provided on the media player 40, while the other end of the audio connector cord is preferably hard-wired to the alarming base 250. An excess length of the audio cord 30 may be coiled around and stored on a collecting spool 170, in the manner previously described with respect to security device 120. Furthermore, a cradle 262 may be formed on the display stand 260 opposite alarming base 250 to support the headphones H in a manageable and more aesthetically pleasing display.

As best illustrated by FIG. 12, the alarm of the merchandise display security device 220 is activated under only one situation, condition or circumstance. The electronics disposed within the alarming base 250 monitor the status of the audio cord 30 and activate the alarm if the audio cord is severed (e.g. electrical continuity along the conductors of the audio cord is interrupted), or if the audio cord is unplugged at the alarming base.

The foregoing has described one or more exemplary embodiments of a merchandise display security device for displaying and protecting audio headphones from theft or removal from a display area in a retail store by an unauthorized person. In certain exemplary embodiment, the security device displays and protects the headphones as well as a media player, such as an audio player, associated with the headphones. In other exemplary embodiments the security device protects only the headphones. Regardless, the security device provides a sense loop through an audio cord extending between the headphones and a component of the security device, and more specifically, a security sensor, display stand or alarming base of the device. In each exemplary embodiment, the security device activates an alarm in the event that the sense loop is interrupted, and more particularly, if electrical continuity along the conductors of the audio cord is lost, or if the audio cord is unplugged from the security sensor, display stand or alarming base, respectively. In certain exemplary embodiments, the security device also activates an alarm in the event that the media player is separated (e.g. detached) from the security sensor.

Exemplary embodiments of a merchandise display security device have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise display security device for an article of merchandise having an audio cord, wherein the article of merchandise is configured to electrically connect to a media player for providing an audio signal to the article of merchandise via the audio cord, the device comprising:

an electrical control circuit for producing a sense loop in the audio cord and for monitoring a non-alarming state and an alarming state of the sense loop, the audio cord and the media player each configured to electrically connect to the electrical control circuit; and an alarm in electrical communication with the electrical control circuit;

wherein the electrical control circuit activates the alarm in the event the sense loop in the audio cord changes from the non-alarming state to the alarming state.

2. A device according to claim 1, wherein the sense loop in the audio cord is interrupted when the audio cord is severed and the state of the sense loop changes from the non-alarming state to the alarming state.

3. A device according to claim 1, wherein the audio cord comprises an audio plug for engaging an audio jack and wherein the sense loop in the audio cord is interrupted when the audio plug is unplugged from the audio jack and the state of the sense loop changes from the non-alarming state to the alarming state.

4. A device according to claim 1, wherein the article of merchandise is headphones having at least one earpiece and wherein the audio cord is electrically connected to the at least one earpiece for providing an audio signal from the media player to the headphones.

5. A device according to claim 1, further comprising a security sensor adapted to be attached to the media player, the security sensor having an audio jack for receiving the audio plug at a free end of the audio cord.

6. A device according to claim 5, wherein the security sensor comprises an audio connector cord having an audio plug at a free end for engaging an audio jack provided on the media player.

7. A device according to claim 5, wherein the electrical control circuit is disposed within an alarming base and wherein the security sensor is electrically connected to the alarming base by a sense cord.

8. A device according to claim 7, wherein the security sensor comprises a contact sensor for engaging the media player and wherein the electrical control circuit activates the alarm when the contact sensor is in an armed state and the media player is separated from the security sensor.

9. A device according to claim 7, wherein the security sensor comprises a power adapter cord having a first connector at a first end for engaging a power output jack provided on the security sensor and a second connector at a second end for engaging a power input jack provided on the media player, and wherein electrical power is supplied to the media player through the sense cord and the power adapter cord.

10. A device according to claim 7, wherein the security sensor is removably supported on the alarming base for displaying the media player.

11. A device according to claim 10, wherein the security sensor and the alarming base each comprise a magnet for aligning the security sensor on the alarming base with the media player in a desired orientation for display.

12. A device according to claim 1, further comprising a display stand having an audio jack for receiving an audio plug at a free end of the audio cord and an audio connector cord having an audio plug at a free end for engaging an audio jack provided on a media player.

13. A device according to claim 12, wherein the electrical control circuit is disposed within an alarming base and wherein the display stand is electrically connected to the alarming base by a sense cord.

14. A device according to claim 1, further comprising a collecting spool for collecting an excess length of the audio cord.

15. A device according to claim 14, wherein the collecting spool comprises an elongate cylindrical rod having a slot formed at each end for securing the audio cord therein with the excess length of the audio cord coiled around the rod.

16. A device according to claim 1, wherein the audio cord and the media player are each configured to electrically connect to the electrical control circuit such that the electrical control circuit is disposed between the audio cord and the media player.

17. A merchandise display security device for headphones having an audio cord, the device comprising:

an alarming base;

a security sensor electrically connected to the alarming base by a sense cord and adapted for attaching to a media player, the security sensor comprising:

an audio jack for receiving an audio plug at a free end of the audio cord; and an audio connector cord having an audio plug at a free end for engaging an audio jack provided on a media player;

an electrical control circuit disposed within at least one of the alarming base and the security sensor;

wherein the electrical control circuit produces an electrical sense loop in the audio cord and activates an alarm in the event the sense loop in the audio cord is interrupted.

18. A device according to claim 17, wherein the security sensor further comprises a contact sensor for engaging the media player and wherein the electrical control circuit activates the alarm when the contact sensor is in an armed state and the media player is separated from the security sensor.

19. A device according to claim 17, wherein the security sensor further comprises a power adapter cord having a first connector at a first end for engaging a power output jack provided on the security sensor and a second connector at a second end for engaging a power input jack provided on the media player, and wherein electrical power is supplied to the media player through the sense cord and the power adapter cord.

20. A merchandise display security device for headphones having an audio cord, the device comprising:

a display stand having an audio jack for receiving an audio plug provided at a free end of the audio cord and comprising an audio connector cord having an audio plug at a free end for engaging an audio jack provided on a media player; and an electrical control circuit in electrical communication with the audio cord and with an alarm;

wherein the electrical control circuit produces a sense loop in the audio cord, monitors the sense loop in the audio cord, and activates an alarm in the event that the sense loop is interrupted.

* * * * *